United States Patent [19]

Lobbestael

[11] 4,243,156

[45] Jan. 6, 1981

[54] CLOSURE FOR A BEVERAGE RECEPTACLE

[76] Inventor: David A. Lobbestael, 1148 Dexter-Pinckney Rd., Pinckney, Mich. 48169

[21] Appl. No.: 21,991

[22] Filed: Mar. 19, 1979

[51] Int. Cl.[3] ..... B65D 41/32

[52] U.S. Cl. ..... 222/541; 220/90.4; 220/265

[58] Field of Search ..... 222/541; 220/90.2, 90.4, 220/90.6, 265, 268

[56] References Cited

U.S. PATENT DOCUMENTS

| | | | |
|---|---|---|---|
| 2,608,841 | 9/1952 | Rice . | |
| 2,612,765 | 10/1952 | Gorey . | |
| 3,003,668 | 10/1961 | Sherlock et al. | 222/541 |
| 3,197,089 | 7/1965 | Michael . | |
| 3,430,826 | 3/1969 | Microulis . | |
| 3,471,058 | 10/1969 | Latham et al. . | |
| 3,750,722 | 8/1973 | Nowak . | |
| 4,081,103 | 3/1978 | Zoellick | 220/90.4 |
| 4,187,954 | 2/1980 | Striggow | 222/541 X |

*Primary Examiner*—Joseph J. Rolla
*Attorney, Agent, or Firm*—Gifford, VanOphem, Sheridan & Sprinkle

[57] ABSTRACT

A closure is provided for use with a beverage receptacle, such as a paper cup, having an open top. The closure comprises a planar lid having both an upper and lower side and conforming in shape to the open top of the receptacle. An annular rim extending outwardly from the lower side of the lid is dimensioned to frictionally engage the open top of the receptacle in order to secure the lid to the receptacle. The lid further includes a tubular spout extending outwardly from the upper side and adjacent the periphery of the lid. One end of the spout is open to the lower side of the lid while a cap integrally formed with the spout is secured to and closes the other end of the spout. A series of perforations between the cap and the spout permit the manual and permanent removal of the cap from the spout when consumption of a beverage within the receptacle is desired.

6 Claims, 4 Drawing Figures

CLOSURE FOR A BEVERAGE RECEPTACLE

BACKGROUND OF THE INVENTION

I. Field of the Invention

The present invention relates generally to closures and, more particularly, to a closure for a beverage receptacle.

II. Description of the Prior Art

Many persons enjoy drinking coffee or other beverages, hereinafter collectively referred to as "coffee", particularly in the morning and many persons must consume their coffee while traveling in a motor vehicle. Such persons will include, for example, truck drivers, taxicab drivers, traveling salesmen and the like.

Persons who must, as a practical matter, consume their coffee in a motor vehicle oftentimes buy coffee "to go", i.e., coffee contained in a disposable paper or plastic cup having an open circular top. The open top of the disposable cup is typically closed by a plastic lid.

In order to drink the coffee, however, the lid must be removed from the disposable cup which is particularly hazardous in a moving motor vehicle. Spillage of the coffee caused by rapid braking of the motor vehicle, road vibration or the like is a common event and such spillage can undesirably stain one's clothing or the interior of the motor vehicle. Moreover, spillage of hot coffee on the driver of the vehicle is particularly hazardous and can even result in a motor vehicle accident.

There have, however, been a number of previously known closure members which are attachable to a beverage container and many of these closure members include spouts through which the beverage can be consumed without removal of the closure member and which limit the flow of the beverage through the spout. Such closure members, however, have not enjoyed wide use or acceptance for a number of different reasons.

One disadvantage of these previously known closure members is that the closure member is relatively complex, and thus expensive, in construction. The previously known closure members of this type, due to the high cost, economically are unsuitable for disposal after a single use. Thus, such closure members cannot be economically employed for use with the sale of "to go" coffee.

A still further disadvantage of these previously known closure members with spouts is that the spout is continuously open. Consequently, spillage of the beverage through the spout can disadvantageously occur prior to the actual sale of the beverage with this container. Although some of these closure members include caps which can be slid over the spout in order to close it, such caps can be easily and inadvertently dislodged so that the spillage of the beverage through the spout and prior to sale can still occur.

SUMMARY OF THE PRESENT INVENTION

The present invention overcomes the above mentioned disadvantages of the previously known closure members by providing an inexpensive closure member for a disposable beverage container and having a spout with a restricted flow passageway.

In brief, the closure member according to the present invention comprises a substantially planar lid having an upper and lower side and which conforms in shape and size to the open top of the disposable beverage receptacle. An annular rim is formed about the outer periphery and extends outwardly from the lower side of the lid. The rim is dimensioned to frictionally engage the open top of the receptacle in order to secure the lid to it.

The lid further includes a spout which extends outwardly from the upper side and adjacent the periphery of the lid. The spout is tubular and has a restricted inner passageway. One end of the lid is open to the lower side of the lid and thus is open to the beverage contained within the receptacle. A cap is integrally formed with the spout and closes the other or free end of the spout.

A series of perforations however, are provided on the closure member between the spout and the cap which enables the cap to be detached or broken off from the spout when consumption of the beverage is desired. Preferably, a cavity is formed at the free end of the cap so that a user's fingernail can be inserted into the cavity in order to provide the necessary torque to break the cap from the spout.

In the preferred form of the invention, the entire closure is of a one piece construction and is preferably inexpensively constructed from extruded plastic.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
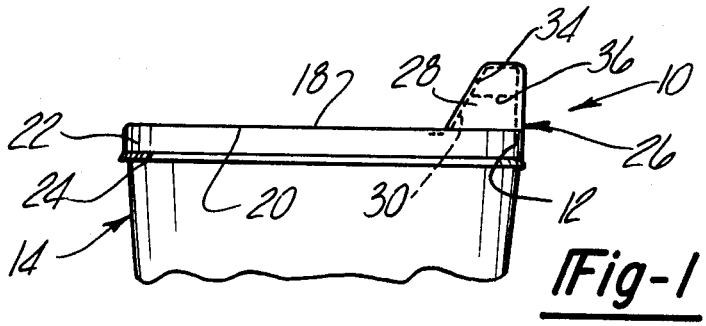
FIG. 1 is a side view illustrating the closure member according to the present invention.
Figure 2:
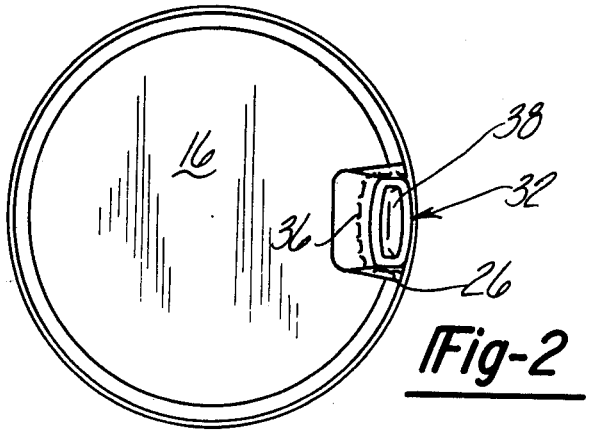
FIG. 2 is a top plan view illustrating the closure member according to the present invention.

With reference first to FIGS. 1 and 2, the closure member 10 according to the present invention is thereshown secured across an open top 12 of a beverage container 14 in a manner which will be subsequently described. The beverage container or receptacle 14 is typically of a plastic, paper or Styrofoam construction and is usually thrown away after the beverage within the receptacle 14 is consumed. The beverage itself can be either a hot beverage, such as coffee or a cold beverage, such as soda pop.

The closure member 10 further comprises a substantially planar lid 16 having an upper surface 18 and a lower surface 20. The lid 16 substantially conforms in shape and size with the open top 12 of the beverage receptacle 14 and, for the beverage receptacle 14 illustrated in the drawing, the lid 16 is circular in shape.

An annular rim 22 extends axially outwardly from the lower side 20 of the lid 16 and around the outer periphery of the lid 16. The rim 22 is constructed of a flexible material, such as plastic, so that upon insertion of the lid 16 over top 12 of the beverage receptacle, the inner periphery 24 of the rim 22 frictionally engages the outside of the receptacle 14 to thereby secure the closure member 10 to the receptacle 14. Alternatively, the rim 22 can be dimensioned to frictionally engage the inside surface of the receptacle 14 to secure the closure member 10 to the receptacle 14.

Still referring to FIGS. 1 and 2, a tubular spout 26 extends outwardly from the upper side 18 and near the outer periphery of the lid 16. The spout 26 has a central passageway 28 which is open at its lower end 30 to the lower side 20 of the lid 16 and thus to any beverage which is contained within the receptacle 14. Moreover, the restricted passageway 28 is restricted in cross-sectional shape for a reason to be hereinafter described.

Figure 4:
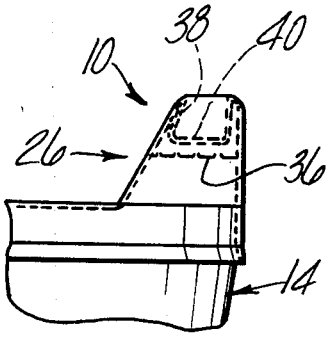
FIG. 4 is a fragmentary side view illustrating the spout and cap and enlarged for clarity.

With reference to FIG. 4, a cap 32 is integrally formed with the spout 26 and extends across and closes the other or upper end 34 of the passageway 28. A series of indentations or perforations 36, however, are formed on the closure member 10 between the cap 32 and the spout 26 which facilitate the manual removal of cap 32 from the spout 26. The indentations or perforations 36 also ensure that the cap 32 is evenly separated from spout 26.

Still referring to FIG. 4, in order to facilitate the removal of the cap 32 from the spout 26, the cap 32 preferably includes a cavity 38 at its upper or free axial end. The base 40 of the cavity 38 is positioned slightly above the indentations 36 and the cavity 38 is sufficiently large to permit the partial insertion of a consumer's fingernail into the cavity 38. Thus, with the consumer's fingernail inserted into the cavity 38 the pressure applied on the fingernail to remove the cap 32 from the spout is applied almost directly to the perforations 36.

Preferably the entire closure member 10 is of a one piece or integral construction for simplicity and low cost manufacture. Moreover, preferably the closure member 10 is constructed of extruded plastic.

Figure 3:
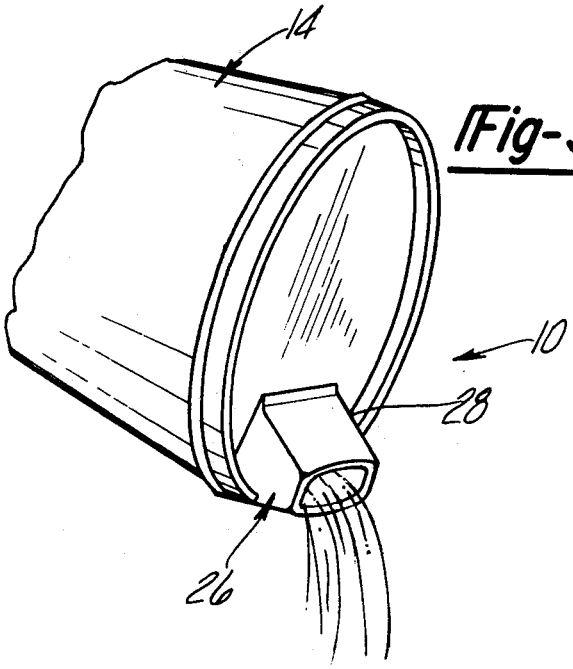
FIG. 3 is a perspective view illustrating the operation of the closure member according to the present invention.

With reference now to FIGS. 1–3, in the use of the closure member 10, the beverage receptacle 14 is first filled, as desired, with the beverage and the closure member 10 is then secured across the open top 12 of the receptacle as shown in FIG. 1. Since the cap 32 closes the upper end of the spout 26, the closure member 10 retains the beverage within its container 14 even in the event that the container 14 falls over on one side.

When consumption of the beverage is desired, the cap 32 is then broken off from the spout 26 around the perforations 36 to thus open the spout 26 (FIG. 3). Once the cap 32 is removed, the beverage within the receptacle 14 can be easily consumed by drinking it through the spout 26. Since the spout passageway 28 is restricted in size, however, the fluid flow rate through the spout 26 is limited. Thus, in the event that the receptacle 14 is accidently knocked over and then picked up, the amount of spillage of the beverage is minimal.

The closure member 10 according to the present invention is particularly advantageous for consuming beverages within a motor vehicle. In the event that the receptacle 14 is jarred by a road vibration, sudden braking of the motor vehicle or by other causes, the beverage within the receptacle 14 splashes against the lid 16 and is, thus, retained within the receptacle 14. Moreover, due to the height of the spout 26, it is unlikely that the beverage will be spilled out through the spout 26.

Having described my invention, however, many modifications thereto will become apparent to those skilled in the art to which it pertains without deviation from the spirit of the invention as defined by the scope of the appended claims.

I claim:

1. A closure for use with a beverage receptacle having an open top, said closure comprising:

a substantially planar lid having an upper and a lower side and substantially conforming in shape to the open top of the receptacle;

said lid including a rim about its outer periphery, said rim extending outwardly from the lower side of the lid and being dimensioned to frictionally engage the open top of the receptacle to thereby retain said lid to said receptacle;

said lid further comprising a tubular spout having a restricted fluid passageway formed adjacent the periphery of said lid and extending outwardly from the upper side of the lid, said spout being open at one end to the lower side of the lid and, at its other end, having a cap integrally formed with and closing said spout;

means formed on said spout to permit manual detachment of said cap from said spout;

wherein said means further comprises a series of indentations formed between said cap and said spout; and wherein said cap includes a cavity at its end most spaced from spout.

2. The invention as defined in claim 1 wherein said indentations are perforations.

3. The invention as defined in claim 1 wherein the base of said cavity is positioned slightly above said series of indentations.

4. The invention as defined in claim 1 wherein said closure is integrally constructed.

5. The invention as defined in claim 1 wherein said closure is integrally constructed from extruded plastic.

6. The invention as defined in claim 1 wherein said lid is circular in shape.

* * * * *

UNITED STATES PATENT AND TRADEMARK OFFICE

CERTIFICATE OF CORRECTION

PATENT NO. : 4,243,156

DATED : January 6, 1981

INVENTOR(S) : David A. Lobbestael

It is certified that error appears in the above-identified patent and that said Letters Patent are hereby corrected as shown below:

Column 1, line 14, delete "will" and insert --would-- therefor.

Signed and Sealed this

*Twenty-third* Day of *June 1981*

[SEAL]

*Attest:*

RENE D. TEGTMEYER

*Attesting Officer*

*Acting Commissioner of Patents and Trademarks*